US005475357A

United States Patent [19]

Chien et al.

[11] Patent Number: 5,475,357

[45] Date of Patent: Dec. 12, 1995

[54] FUSE ASSEMBLY

[76] Inventors: Ming-Chyan Chien, 6F-2, No. 9, Alley 38, Lane 112, Section 2, Chung Shan Road, Shu Lin, Taipei Hsien; Lai-Sheng Lee, No. 1, Lane 103, Ming Der Street, Shin Chuan, Taipei Hsien, both of Taiwan

[21] Appl. No.: 181,177

[22] Filed: Jan. 13, 1994

[51] Int. Cl.[6] ..... H01H 83/143

[52] U.S. Cl. ..... 337/229; 337/227; 337/230

[58] Field of Search ..... 337/229, 230, 337/186, 227, 237

[56] References Cited

U.S. PATENT DOCUMENTS

| | | | |
|---|---|---|---|
| 568,971 | 10/1896 | Ehrhardt | 337/230 |
| 826,974 | 7/1906 | Trumbo | 337/230 |
| 1,404,858 | 1/1922 | Hengstenberg | 337/230 |
| 1,462,195 | 7/1923 | Doyle | 337/230 |
| 1,857,581 | 5/1932 | Athey | 337/230 |
| 2,303,592 | 12/1942 | Weaver | 337/230 |
| 2,497,470 | 2/1950 | Roukos, Jr. | 337/230 |

*Primary Examiner*—Lincoln Donovan
*Attorney, Agent, or Firm*—Bacon & Thomas

[57] ABSTRACT

A fuse assembly includes multiple fuse elements included in one single multiphase grooved shaft member thereof so that the fuse assembly may be used more than once as a safe electrical connection without the need to replace the whole fuse assembly each time a fuse element thereof is blown out. The fuse assembly can therefore be more convenient and practical in use and more economical and effective in cost.

3 Claims, 8 Drawing Sheets

FUSE ASSEMBLY

BACKGROUND OF THE INVENTION

The present invention relates to a fuse assembly, and more particularly to a safety protective fuse assembly which includes multiple fuse elements for use more than once as a safe electrical connection.

There are various types and shapes of fuse assemblies for electric circuits available in the markets, such as a fuse strip, fuse wire, fuse card, fuse tube, etc., each of which may be employed depending on the actual need in the mounting thereof. Such fuse assemblies, no matter what configuration they may have, they all have a fuse element with particular voltage (V), wattage (W), and amperage (A) included therein to provide the basic protection for a safe electrical connection. FIG. 1 illustrates one example of such conventional fuse assemblies. Most of the conventional fuse assemblies are structured with one single fuse element, which, upon blowout, must be replaced with a new one immediately. Since most people might have little knowledge about the type and the way of replacement of the fuse element they are using, or, even if they know how to change the blown out fuse, they might not know the required particular specifications (voltage, wattage, amperage, etc.) of the fuse element. Furthermore, since the particular fuse element with the required specifications might not be easily or conveniently available, even if the user knows both the specifications and the replacement of the blown out fuse element, he or she might have to find the new fuse element at the price of valuable time and efforts the cost of which is absolutely much higher than the cost of the fuse element itself. Alternatively, the user might decide to find a professional electrician to do the replacement to hopefully reduce the possible costs, time, and efforts for such replacement by the user himself/herself. Either way of the above mentioned for the replacement of a blown out fuse assembly for the purpose of safe electrical connection has, nevertheless, become a burden of the consumer and accordingly a defect of the fuse assembly which reduces the effectiveness and value thereof.

It is therefore tried by the inventor to develop a fuse assembly which eliminates the drawbacks and problems of the conventional fuse assemblies particularly found in the replacement thereof.

SUMMARY OF THE INVENTION

A primary object of the present invention is therefore, to provide a fuse assembly the improvement of which is that it has a plurality of fuse elements and therefore, can be used more than once without changing the fuse assembly each time a fuse element thereof is blown out while the safe electric connection it provides will not be reversely influenced. That is, the fuse assembly according to the present invention can be used in a more economical and convenient manner.

The fuse assembly according to the present invention for achieving the above object mainly has a multiphase grooved shaft member and a clear casing enclosing the longitudinal periphery of the grooved shaft and thereby forming multiple separated longitudinal compartments between the casing and the grooves of the grooved shaft. Each of the longitudinal compartments has disposed therein a fuse element. A multiphase head member is connected to each end of the grooved shaft such that each phase conductor disposed on the outer periphery of the head members connects one of the fuse elements at one end thereof and is electrically connected to a corresponding phase conductor disposed on the other head member via the fuse element extending through the longitudinal groove of the multiphase grooved shaft member. Since there are multiple fuse elements included in one single fuse assembly, the fuse assembly each may provide multiple times of safe electrical connection without the necessity of discarding or replacing the fuse assembly each time a fuse element thereof is blown out.

DETAILED DESCRIPTION OF THE PREFERRED EMBODIMENTS

Figure 1:
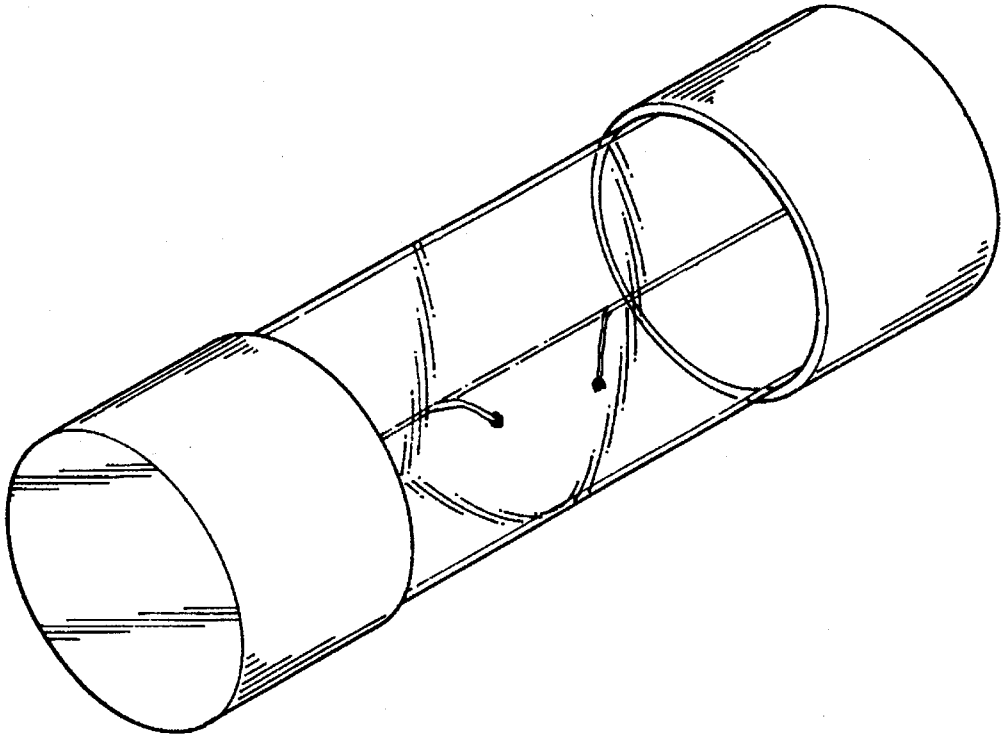
FIG 1 PRIOR ART
FIG. 1 is a perspective showing a conventional fuse assembly in tubular shape with only one single fuse element therein.
Figure 2:
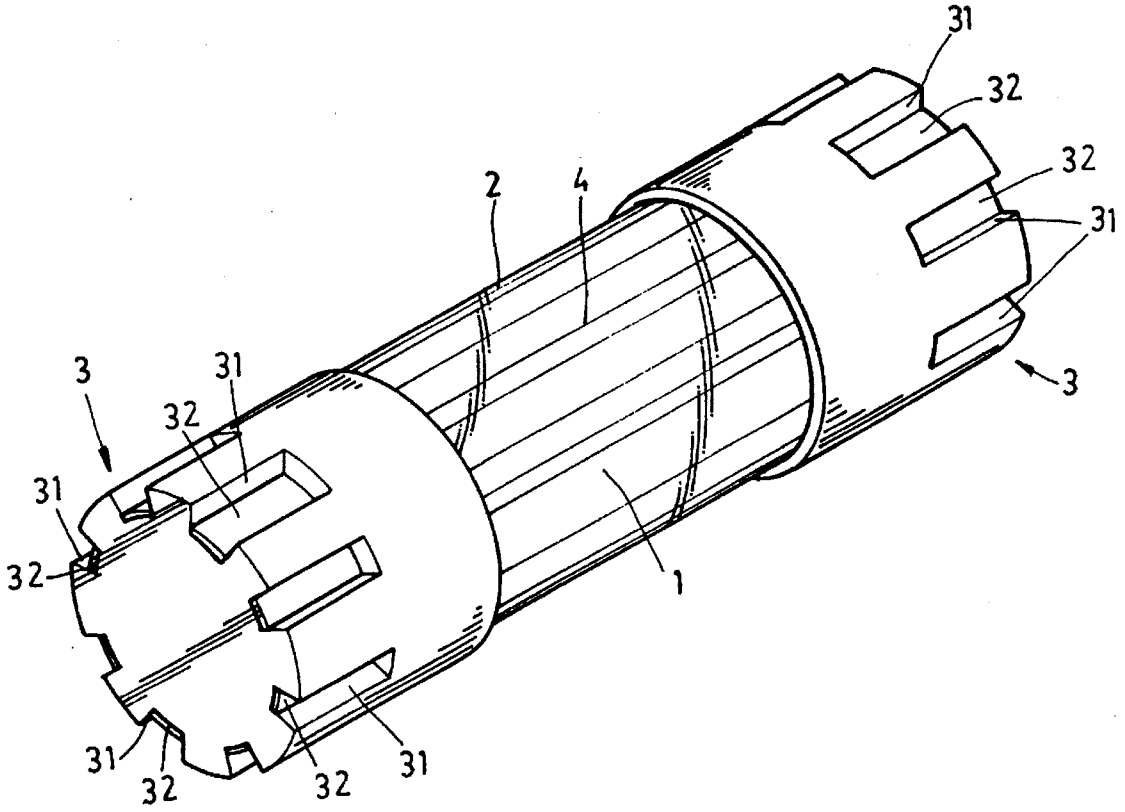
FIG. 2 is a perspective of the fuse assembly of a first embodiment of the present invention.
Figure 3:
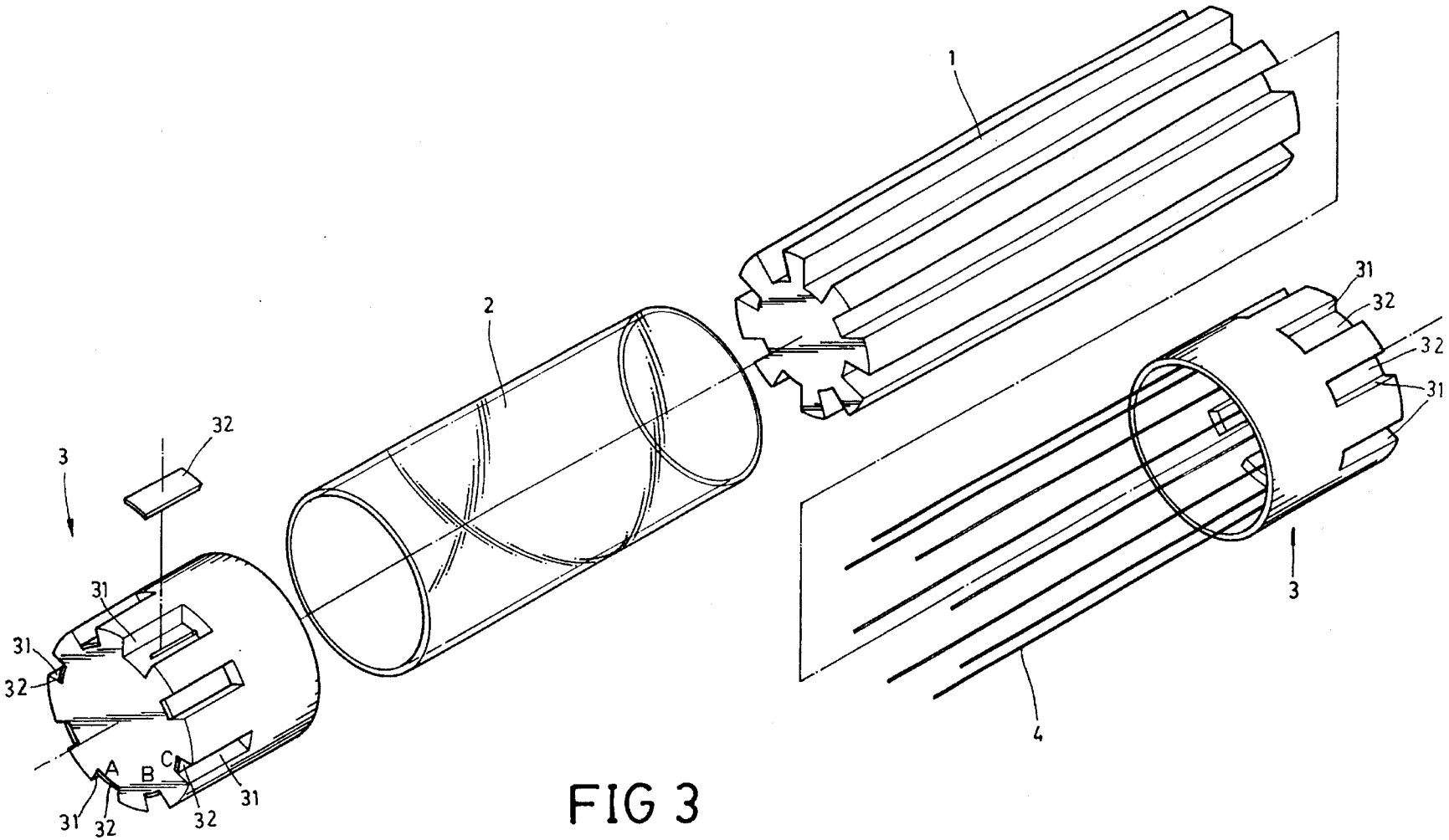
FIG. 3 is an exploded view of the fuse assembly of FIG. 2.

Please refer to FIGS. 2 and 3, in which a fuse assembly according to the first embodiment of the present invention and an exploded view thereof are shown. The fuse assembly consists of a multiphase grooved shaft member 1, a casing 2 which encloses the length of the grooved shaft member 1 and may be made of, but not limited to, a clear material, two multiphase head members 3 separately attached to the outer ends of the casing 2 and of the grooved shaft member 1, accordingly, and a plurality of fuse elements 4 extending between two ends of the grooved shaft member 1.

The multiphase grooved shaft member 1 is an elongated rod in proper length and has a plurality of phase grooves 11 formed thereon in the longitudinal direction of the shaft member 1 and extending full length of the shaft member 1. When the shaft member 1 is enclosed by the clear casing 2 with a minimum clearance with them, a plurality of separated elongated compartments are formed between the casing 2 and each of the phase grooves 11.

The multiphase head members 3 are made of dielectric material and have multiple phase grooves or recesses 31 formed on their respective periphery near their distal ends, such that the distal ends thereof have a shape of toothed wheel. The dimensions of the head members 3 are such that they permit the head members 3 to attach two outer ends of the assembled shaft member 1 and casing 2. The numbers and positions of the phase grooves 31 on both head members 3 correspond to those of the phase grooves 11. On a bottom surface of each phase groove 31, there is disposed a conductive plate 32 for electrically connecting a power supply. The conductive plates 32 in the corresponding phase grooves 31 separately on one of the two head members 3 connect at their inward-directed ends one of the fuse elements 4 having predetermined voltage (V), wattage (W), and amperage (A).

The fuse elements 4 each is disposed in one of the elongated compartments formed between the phase grooves 11 and the casing 2 and extends the full length of the shaft member 1, so that two ends of each fuse element 4 are separately connected to the conductive plates 32 in the corresponding phase grooves 31, and the two conductive plates 32 are thereby electrically connected via the fuse element 4.

Figure 4:
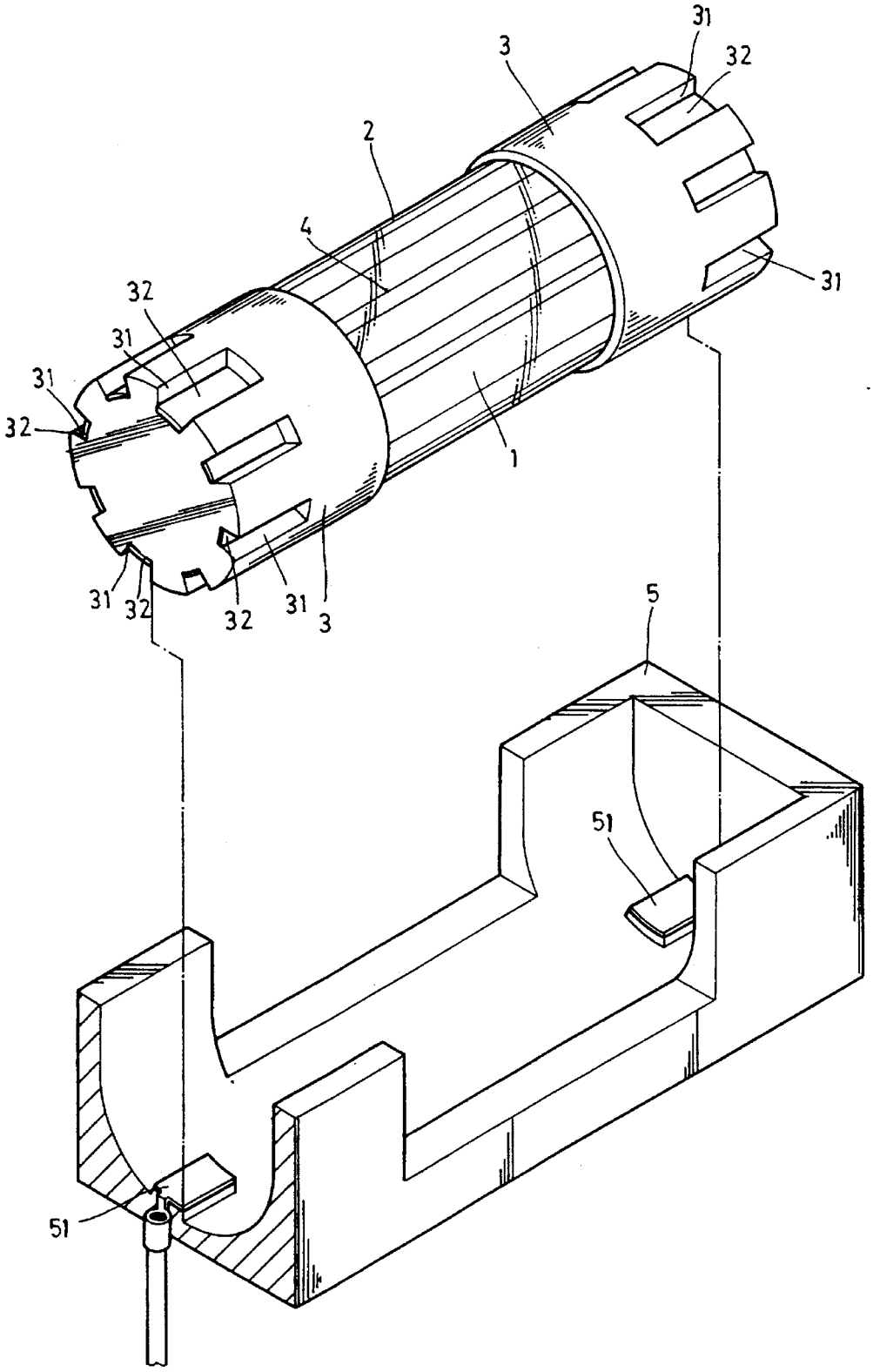
FIG. 4 illustrates a matching fuse holder of the fuse assembly of FIG. 2, and the manner in which the fuse assembly is disposed in the fuse holder.

When the fuse assembly according to the first embodiment is formed by assembling the above elements and ready for use, it is positioned into a fuse holder 5, as shown in FIG. 4. The fuse holder 5 consists of two contact points 51 constituting each is substantially a small plate having the contour and position permitting close contact of the contact point 51 with the conductive plate 32 in the phase groove 31 of the head member 3 when the fuse assembly of the present invention is positioned into and pressed against the fuse holder 5, and thereby forming security protective means in the electric circuit.

In the event a first fuse element 4 extending into a first pair of phase grooves 31 is blown out, simply remove the fuse assembly of the present invention from the fuse holder 5, rotate the fuse assembly so that a second pair of phase grooves 31B are located on and closely contact the contact points 51 on the fuse holder 5. At this point, a second fuse element 4 again effectively functions to safely electrically connect the two contact points 51 without the need to completely replace the fuse assembly with a new one until all the fuse elements in the fuse assembly are blown out which surely would not come within a very short period of time. Accordingly, the fuse assembly according to the present invention is more economical in cost and more efficient in use.

Figure 5:
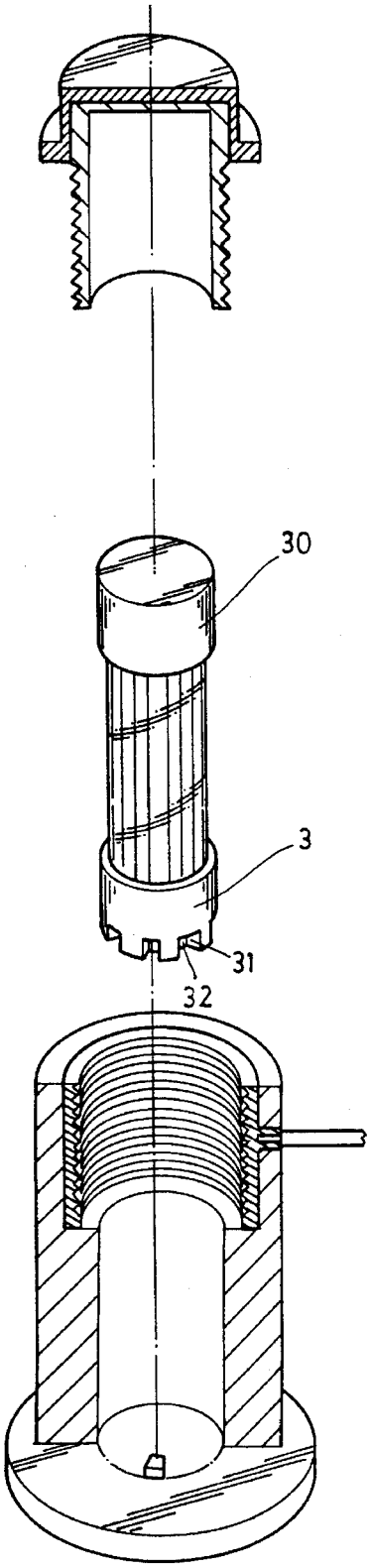
FIG. 5 illustrates the fuse assembly of a second embodiment of the present invention, in which only one end thereof is provided with a multiphase head member.

In another embodiment of the present invention, the fuse assembly does not necessarily have its both head members 3 to be multiphase grooved. That is, the fuse assembly of the second embodiment has one head member 3 the same as that of the first embodiment described above while the other head member 3 thereof has an ordinary smooth outer surface 30. This second embodiment of the present invention is shown in FIG. 5.

Figure 6:
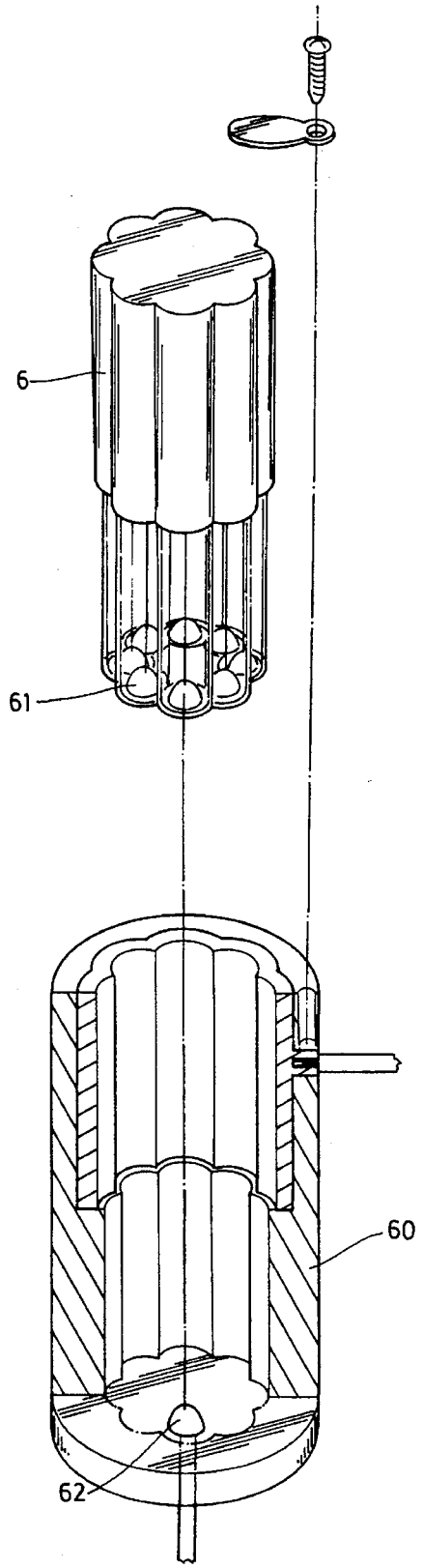
FIG. 6 illustrates the fuse assembly of a third embodiment of the present invention in which the multiphase shaft member thereof has a substantially round cross section with multiple continuous and identical convex curve segments forming the circumferential periphery thereof.

In a further embodiment of the present invention, which is shown in FIG. 6, the fuse assembly has a shaft member 6 which is substantially a cylindrical tube having a substantially round cross section with multiple continuous and identical convex curve segments forming the circumferential periphery thereof. The head members 3, phase grooves 31, and conductive plates 32 of the previous embodiments are all omitted and are substituted by a plurality of separated and independent, approximately semi-spherical contact points 61 forming at one end of the shaft member 6. The shaft member 6 is positioned in a matching fuse holder 60. Each of the contact points 61 has a concave bottom surface, such that each of such semi-spherical contact points 61 may correspondingly engage with an axially upward projected semi-spherical contact point 62 in the fuse holder 60 when the fuse assembly is disposed in the fuse holder 60. When one of the fuse elements in the shaft member 6 is blown out, simply removing the shaft member 6 from the fuse holder 60, rotating the shaft member 6, and replacing it into the fuse holder 60 again with a new contact point 61 contacting the contact point 62, the fuse assembly may then safely function as a new one.

Figure 7:
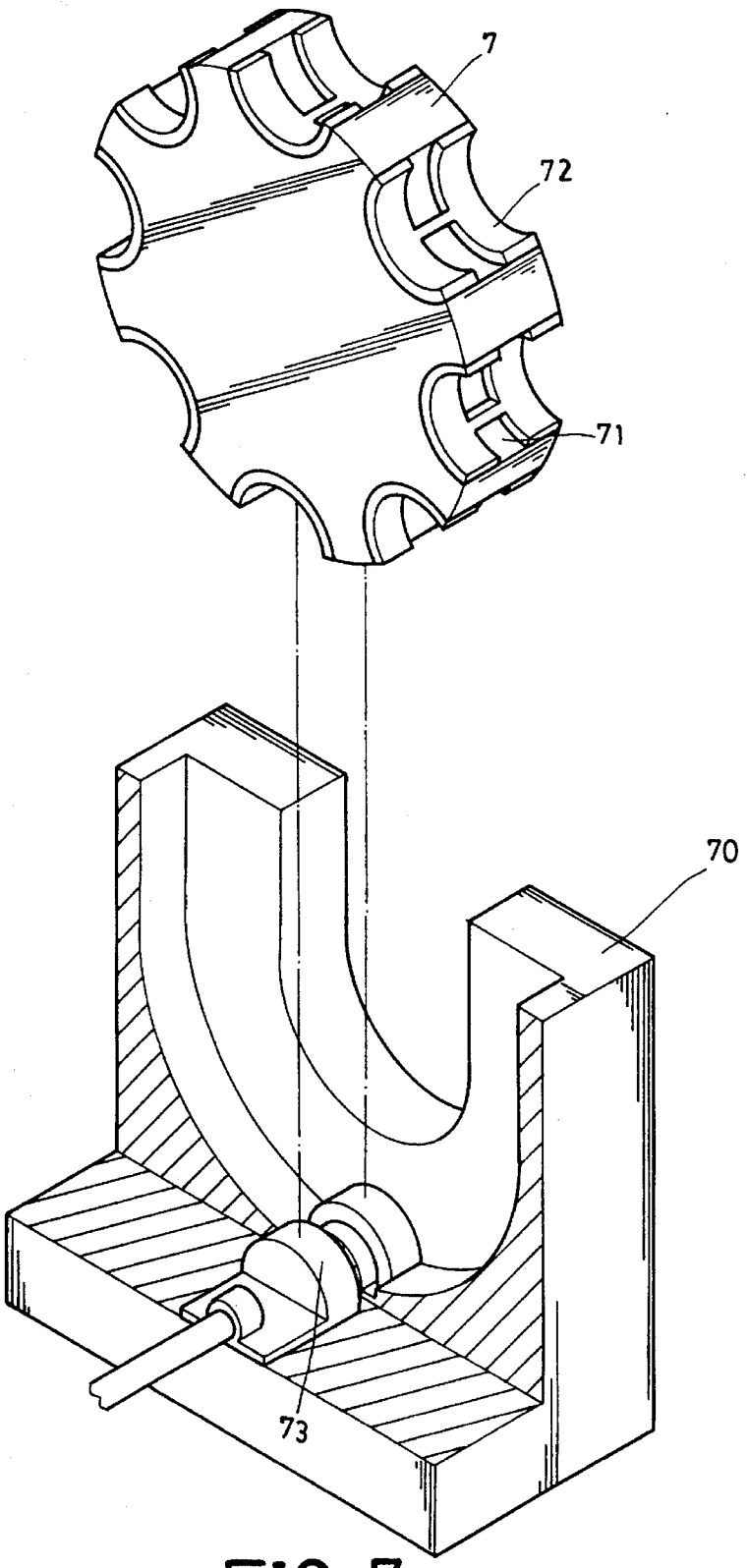
FIG. 7 illustrates the fuse assembly of a fourth embodiment of the present invention which is substantially a circular body in a certain predetermined thickness and having multiple radially concave recesses formed on its outer periphery.

FIG. 7 illustrates a still further embodiment of the present invention for use in special occasions, if required. The fuse assembly according to this embodiment has a subtantially circular body 7 which is used to substitute for the multiphase grooved shaft member 1 in those previous embodiments. The circular body has a predetermined thickness and has multiple continuous and identical radially concave phase recesses 71 formed on its circumferential periphery and functioning as those phase grooves 11 in the previous embodiments. In each concave phase recess 71, a fuse link 72 having similarly curved as that of the phase recess 71 is disposed. A matching fuse holder 70 is provided to receive the circular body 7 therein with a substantially convex contact point 73 thereof engaging with one of the concave phase recesses 71 and thereby contacting the fuse link 72 disposed therein.

Figure 8:
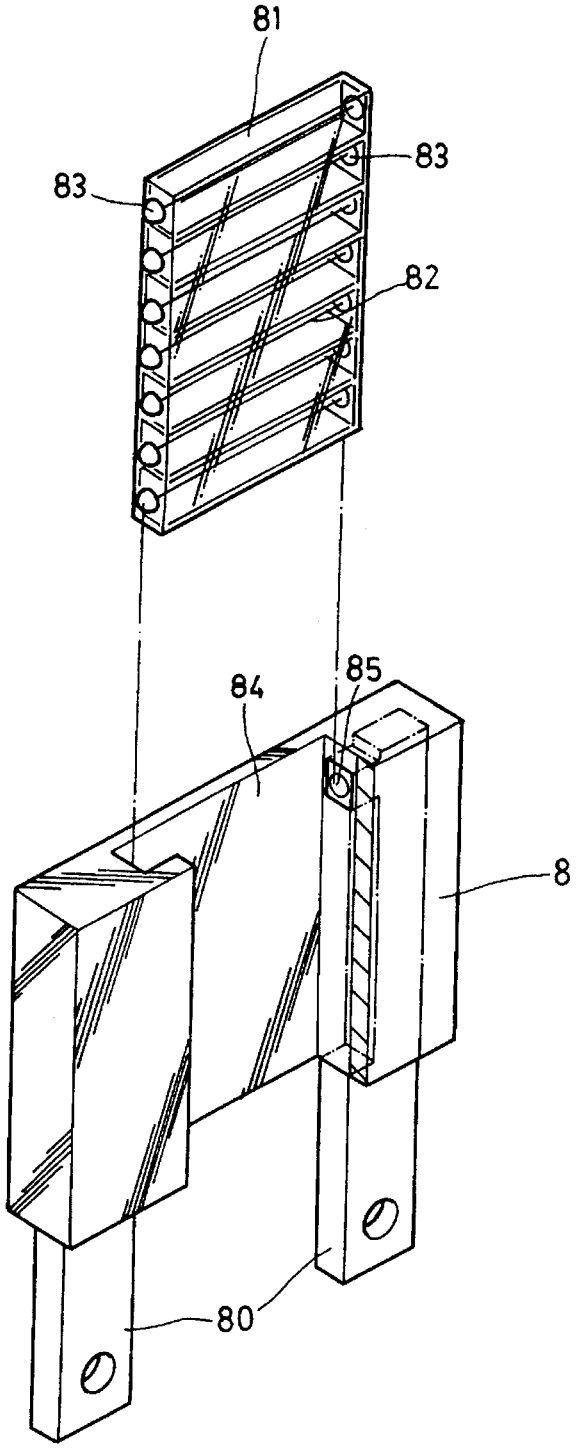
FIG. 8 illustrates the fuse assembly of a fifth embodiment of the present invention which is substantially a pallet fuse assembly.

FIG. 8 illustrates a still further embodiment of the present invention in which a pallet fuse assembly 81 is substituted for the multiphase grooved shaft member 1 in the previous embodiments. The pallet fuse assembly 81 consists of multiple independent and parallelly spaced fuse elements 82 and outward projected contact points 83 arranged at two outer edges of the pallet fuse assembly 81 to which one end of a respective one of the fuse elements 82 is connected. A matching fuse holder 8 has two legs 80, between them a guiding recess 84 is formed and a pair of receiving holes 85 are provided, such that the pallet fuse assembly 81 may be shifted up or down within the guiding recess 84 with the contact points 83 thereof electrically connecting the fuse element 82 with the receiving holes 85 when the projected contact points 83 project into and contact the receiving holes 85.

What is claimed is:

1. A fuse assembly comprising:

an elongated shaft member having first and second longitudinally spaced ends, said shaft member including a plurality of circumferentially spaced grooves extending longitudinally along an outer periphery of said shaft member from the first end to the second end thereof;

an elongated transparent casing extending about said shaft member such that said casing and each one of said grooves defines a respective elongated compartment;

a plurality of elongated fuse elements, each one of said fuse elements being positioned in a respective one of said compartments;

a first head member mounted at the first end of said shaft member;

a second head member, formed separate from said shaft member, mounted at the second end of said shaft member, said second head member having an outer surface including a plurality of circumferentially spaced recesses, each of said recesses being aligned with a respective one of said grooves such that each one of said fuse elements extends within a respective one of said grooves, through a portion of said second head member and into a respective one of said recesses, and a plurality of conductors, each one of said conductors being positioned in a respective one of said recesses and being in electrical contact with a respective one of said fuse elements.

2. A fuse assembly as claimed in claim 1, wherein said first head member is also formed separate from said shaft member and includes a plurality of circumferentially spaced recesses each of which is in longitudinal alignment with a respective one of said grooves, said fuse assembly also including a plurality of second conductors each of which is arranged in a respective one of the recesses in said first head member and in electrical contact with a respective one of said fuse elements.

3. A fuse assembly as claimed in claim 2, wherein each of said fuse elements extends into a respective pair of the recesses in said first and second head members.

* * * * *